United States Patent [19]

Nakazima

[11] 4,301,348

[45] Nov. 17, 1981

[54] PROCESS FOR PRODUCING LARGE-SIZED RECTANGULAR OR SQUARE STEEL PIPES

[75] Inventor: Hiromu Nakazima, Itami, Japan

[73] Assignee: Kabushikikaisha Nakazima, Osaka, Japan

[21] Appl. No.: 93,336

[22] Filed: Nov. 13, 1979

[30] Foreign Application Priority Data

Nov. 17, 1978 [JP] Japan ..... 53-142681
Feb. 21, 1979 [JP] Japan ..... 54-19985

[51] Int. Cl.[3] ..... B23K 31/06

[52] U.S. Cl. ..... 219/61.2; 72/52; 219/8.5; 219/59.1; 228/146; 228/173 F

[58] Field of Search ..... 219/8.5, 10.41, 59.1, 219/61.1, 61.11, 61.2; 228/146, 147, 173 F; 72/51, 52, 370

[56] References Cited

U.S. PATENT DOCUMENTS 3,230,336 1/1966 Gueugnier ..... 219/8.5
3,337,944 8/1967 Morris ..... 219/8.5 X
3,603,761 9/1971 Wogerbauer ..... 219/59.1

FOREIGN PATENT DOCUMENTS 1355978 7/1974 United Kingdom ..... 219/59.1
500934 4/1976 U.S.S.R. ..... 219/59.1

*Primary Examiner*—Volodymyr Y. Mayewsky
*Attorney, Agent, or Firm*—Jordan and Hamburg

[57] ABSTRACT

A process for producing large-sized square steel pipe includes the steps of continuously paying off steel plate from a roll of the same, removing strain from the plate while conveying the plate, and cutting the plate to predetermined lengths. The lengths of plate are successively bent into a shape resembling a rectangular or square pipe having corner portions with angles slightly larger the 90°. The successive plates are tack-welded and opposed outer rollers are pressed against the outer sides of the plate while the plate is conveyed longitudinally thereof. The opposed edges of the plate are thereafter welded together by high frequency welding.

6 Claims, 4 Drawing Figures

FIG. I.

PROCESS FOR PRODUCING LARGE-SIZED RECTANGULAR OR SQUARE STEEL PIPES

BACKGROUND OF THE INVENTION

The present invention relates to improvements in a process for producing large-sized steel pipes of rectangular or square configuration for use in buildings and other structures.

Such a large-sized steel pipe having a rectangular or square configuration (hereinafter referred to simply as "square steel pipe") is usually produced by bending two steel plates into U-shaped sections respectively and joining the bent plates by butt welding. Since the steel pipe thus produced has two weld lines, the welding material and operation account for a substantial portion of the cost of the pipe, and removal of the strain resulting from the welding operation is similarly costly. These factors present difficulties in reducing the manufacturing cost of steel pipes. Whereas steel pipes of small size can be produced by bending a steel plate and welding the plate along a single line, production of large-sized steel pipes, 350 mm×350 mm or larger in cross section, usually involves many difficulties in the bending of the material and in the other processing steps, so that it has heretofore been considered impractical to produce large-sized steel pipes from a single plate.

Furthermore, the conventional process comprises many steps such as edge preparation and bending of two steel plates, fitting, tack welding and welding of the bent plates, and removal of strain from the welded product. Accordingly the process is difficult to practice by a continuous operation, requires labor for the transfer of the workpieces from step to step and consequently renders the product relatively costly.

To overcome these problems, applicant has already proposed a process for producing large-sized square steel pipes from a single steel plate, but the proposed process still involves the following problem. Since the steel plate is cut to predetermined lengths and each length of plate is separately formed into the rectangular or square shape prior to welding the welding phase of the process is repeatedly interrupted. This results in wasted time and greater welding time. The workpiece must be cut to an altered length every time the length of the steel pipe to be produced is altered. This requires an interruption of the processing operation. Moreover, when the workpiece is welded by submerged welding, the workpiece needs edge preparation and, when shaped into a tubular form, must also be welded from inside. Thus the prior process still remains to be fully simplified.

Reference is made to aplicant's co-pending U.S. application Ser. No. 48,535, filed June 13, 1979.

SUMMARY OF THE INVENTION

An object of this invention is to produce a large-sized square steel pipe from a single steel plate with a great reduction in the amounts of welding and processing required.

Another object of the invention is to provide a process for continuously producing steel pipes without an interruption of the operation even when the length of the pipes to be produced is altered.

Another object of the invention is to eliminate the necessity of welding tubular workpieces from inside.

Another object of the invention is to eliminate edge preparation for steel plate workpieces.

Still another object of the invention is to make it possible to weld the workpiece over the largest possible length continuously for efficient welding without an interruption of the welding operation that would lead to waste of time.

To fulfill these objects, the present invention in one aspect thereof provides a process for producing a large-sized steel pipe of square configuration from a single plate which process comprises the following steps. A steel plate is continuously and sequentially paid off from a roll of the same, passed through a leveller to remove strain from the plate and thereafter cut to a predetermined length. Each length of the plate is trimmed at opposite side portions thereof. The length of steel plate is bent to form a longitudinally extending base, opposed sidewalls angularly disposed relative to the base at respective angles greater than 90°, and a top wall constituted by inwardly directed extensions of the sidewalls which terminate in spaced apart longitudinally extending edges. In the forming roll unit outer rollers are positioned externally of the bent plate in contact with the underside of the base and with the sidewalls. The bent plate is moved longitudinally thereof relative to the rollers and, at the same time, the outer sidewall rollers are pressed against the bent plate. The longitudinally extending edges are pressed into substantially abutting relationship by at least one top roller and then welded by high frequency welding to form the steel pipe. The outer rollers are arranged as spaced apart from one another. The top roller is placed on the top wall to press the top wall to the desired shape while effecting relative movement between the roller and the bent plate.

The steel plate is formed into a shape resembling the square pipe so that the opposite side edges of the plate will be joined together in the center of one side of the square pipe obtained. After each steel plate has been bent to form the base, sidewalls and top wall but before it is pressed by the rollers, the bent plate, while being transported longitudinally thereof, is tack-welded at its rear end opposed to the direction of transport to the front end of the following bent plate by a travelling tack welding machine. Subsequently the bent plates are continuously welded instead of welding the plates individually with an interruption. The plate is so bent that the sidewalls are angularly disposed relative to the base at respective angles greater than 90°. The welded pipe is passed through a strain removal zone to remove strain from the pipe and is thereafter passed through a weld inspection zone for the inspection of the weld. The steel plates or bent plates are transferred from step to step on rollers.

Other objects and features of this invention will become apparent from the following description of embodiments with reference to the accompanying drawings.

DESCRIPTION OF THE PREFERRED EMBODIMENTS

Figure 1:
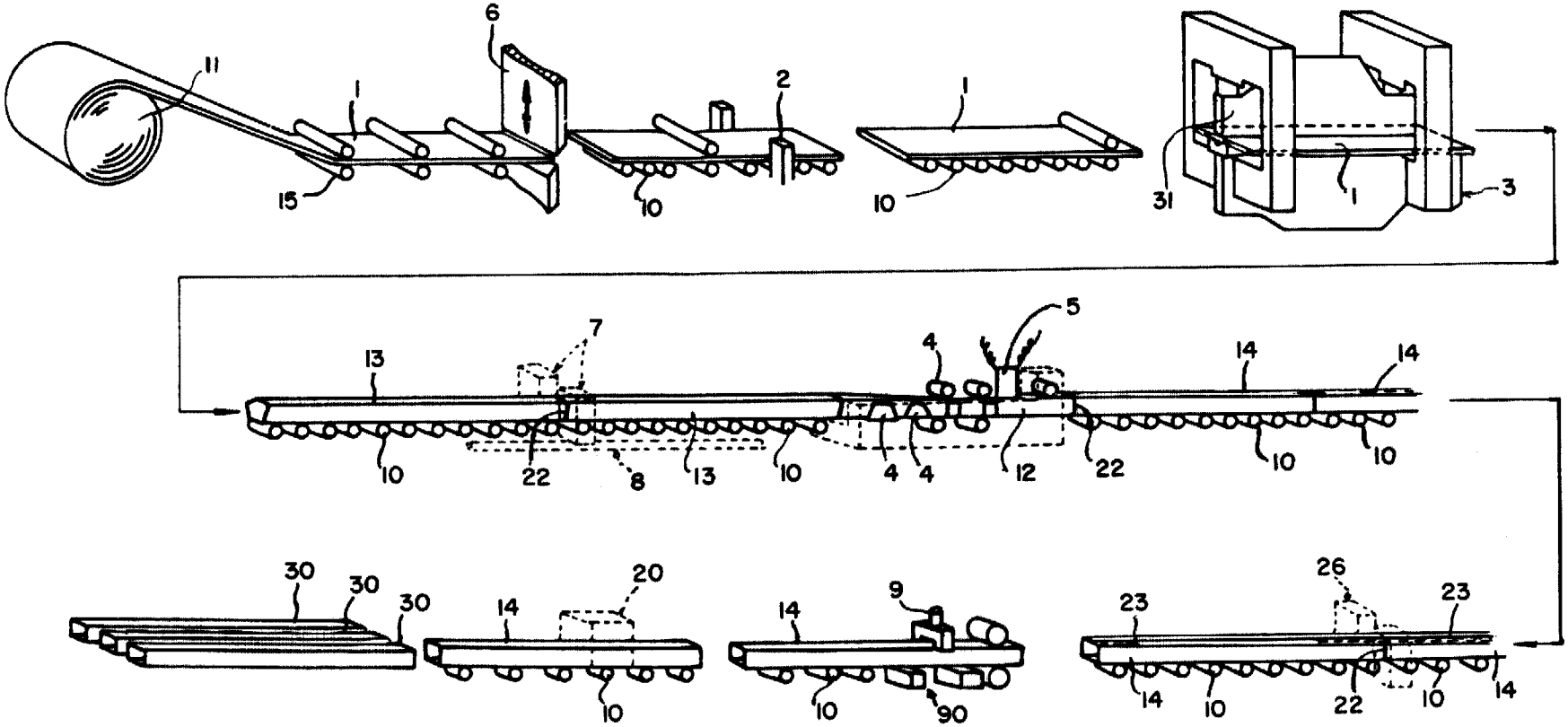
FIG. 1 is a diagram showing a process embodying this invention.
Figure 2:
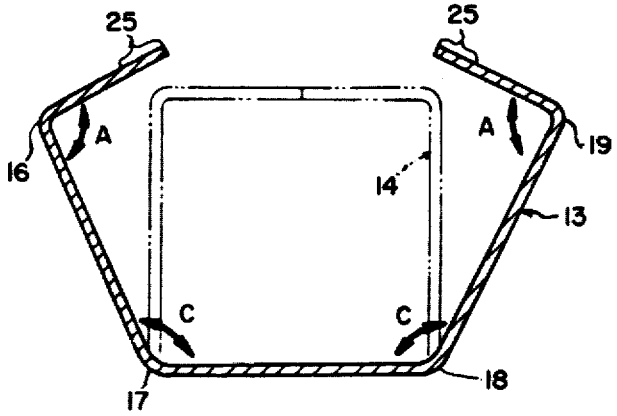
FIG. 2 is a cross sectional view showing a plate formed by bending.
Figure 3:
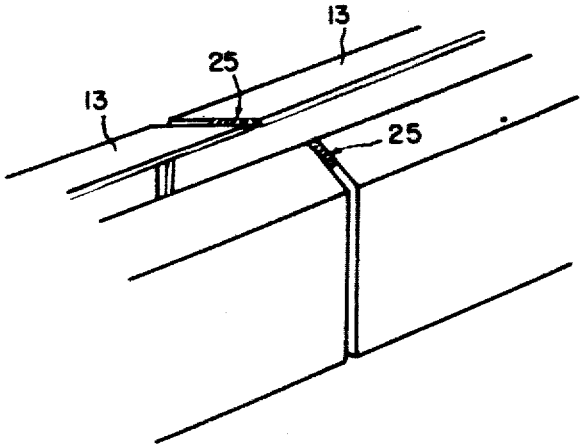
FIG. 3 is a perspective view showing tack-welded portions of bent plates.

With reference to FIG. 1, a steel plate 1 is paid off from a roll 11 of the same at a feeding station and then passed through a leveller 15 to eliminate bends therein. Subsequently the continuous steel plate 1 is cut to a predetermined length by shears 6. While being longitudinally advanced by conveyor rollers 10, each length of steel plate 1 is trimmed at its opposite side portions by a cutter 2. The length of steel plate 1 is fed by conveyor rollers 10 to a press 3, in which the portions of the plate corresponding to the corners of the square steel pipe to be produced are bent. By this forming operation, a corner 16 is first bent through a predetermined angle, then a corner 17, further a corner 19 and finally a corner 18 (see FIG. 2). Preferably the corners 16 and 19 have an angle A of 92°, and the corners 17 and 18 an angle C of 115°. The plate 1 is thus formed into a shape resembling the square steel pipe having the cross section indicated in solid lines in FIG. 2. The formed plates 13 thus obtained are withdrawn from the forming press 3 by conveyor rollers 10 and are advanced in succession longitudinally thereof on other conveyor rollers 10. During this travel, each preceding formed plate 13 is tack-welded, at its rear end, to the front end of the following formed plate 13 by a travelling tack welding machine 7 arranged on each side of the row of conveyor rollers 10. The adjacent plates 13 are tack-welded at the opposed top wall end portions 25 as seen in FIGS. 2 and 3. The top wall portions of the two plates 13 to be tack-welded must be perfectly flush with each other, so that adjusting means, such as holding rollers for holding the bent plates sidewise or from above, may be provided on the travelling tack-welding machine 7 or separately from the machine to properly position the wall portions flush with each other. The tack welding machine 7 is made reciprocally movable on a rail 8 disposed along either side of the row of conveyor rollers 10 so as to perform tack welding while travelling with the bent plates 13 to a position close to a forming roll unit 4, the machine 7 being thereafter returnable to the next following junction 22 of bent plates to repeat the same tack welding operation. The bent plates are fed to a forming roll unit 4 after the plates have been joined to one another. In the roll unit 4, the bent plate is pressed inward from opposite sides thereof by rollers from stage to stage while being pressed from above by a top roller, whereby the angles of the corners 17 and 18 are reduced to 90°. As a result, the opposed longitudinal side edges of each plate are brought into abutting relationship and are welded together by a high frequency welding machine 5. Since the plate can be welded through the entire thickness of the plate, the plate can be completely welded by a single pass without the necessity of welding the pipe-shaped plate from inside. High frequency welding, unlike submerged arc welding conventionally resorted to, needs no deposited metal, generates a smaller amount of heat and therefore causes less strain in the product. This welding method requires no edge preparation and accordingly serves to simplify the process. The welding operation is conducted by high frequency induction welding or high frequency resistance welding. With the process described above, a plurality of formed plates joined to one another can be continuously welded without an interruption that would be needed when the plates are welded individually. This assures a higher welding speed. While the welding operation requires a considerable period of time for starting as well as for an interruption if the plates are welded individually, such waste of time is avoidable when a plurality of formed plates are welded by a single pass as joined to one another.

The welded pipes 14 thus obtained in the desired form are sent forward on conveyor rollers 10, and in the meantime, they are cut at the tack-welded portions 25 by a travelling cutter 26 arranged alongside the roller 10. When desired, the individual pipes are made smooth-surfaced by removing excess metal from the zone 23. The pipes are thereafter fed to a strain removing unit 9, in which they are pressed or rolled to remove longitudinal strain. Subsequently the pipes 14 are passed through an inspecting unit 20, such as an ultrasonic flaw detector, by rollers 10 for the inspection of the weld zone. The pipes are now delivered as finished pipes 30.

Figure 4:
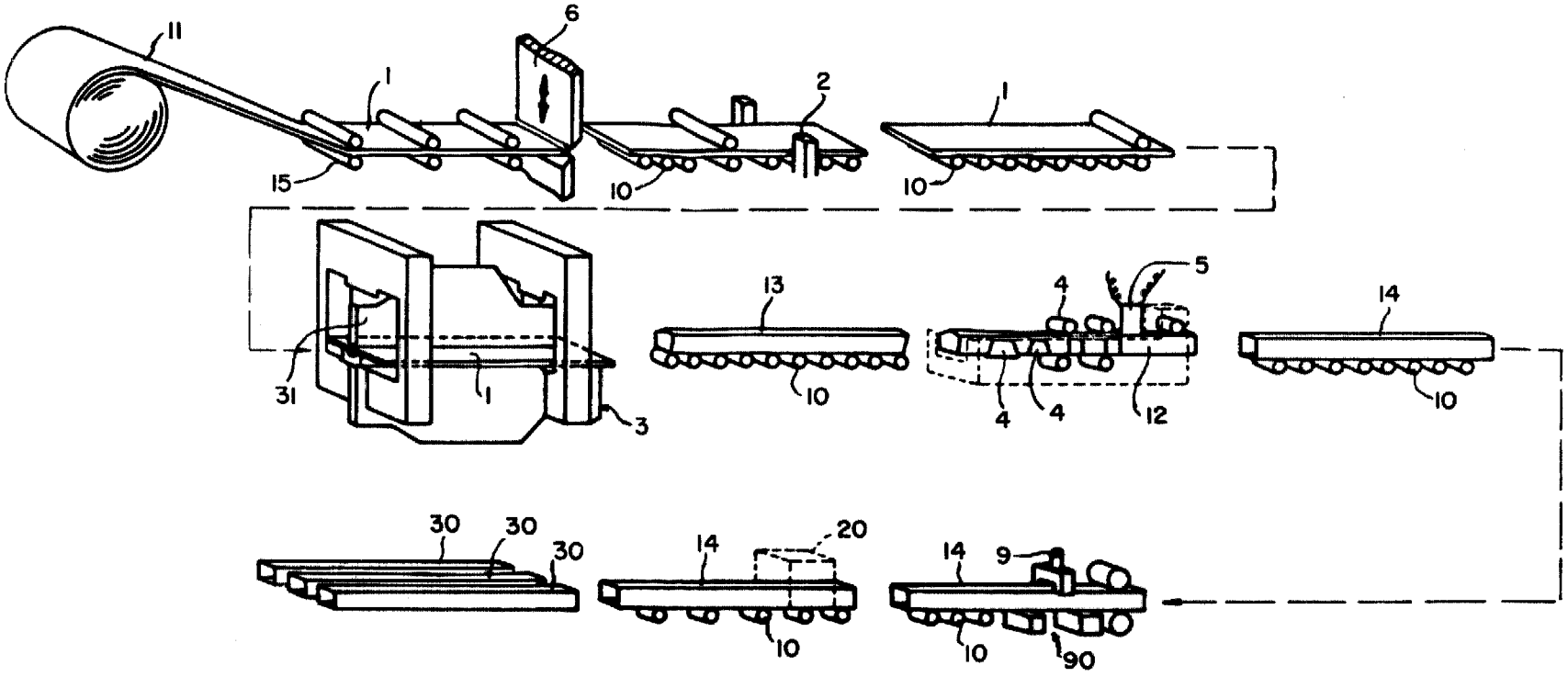
FIG. 4 is a process diagram showing another embodiment.

FIG. 4 shows another embodiment of the invention which does not include the step of joining bent plates 13 to one another longitudinally thereof. Otherwise the process is similar to that shown in FIG. 1. A steel plate is continuously paid off from a roll of the same also in this embodiment, so that when the length of the steel pipe to be produced is altered, the steel plate needs only to be cut to the altered length, and there is no need to interrupt the operation for the alteration of the size of the workpiece. The embodiment employs high frequency welding, which serves to simplify the process because the workpiece does not require edge preparation and can be welded only one one side.

We claim:

1. A process for producing large-sized steel pipes of rectangular or square configuration from steel plate comprising:

continuously paying off steel from a roll of same;

cutting the paid-off steel into predetermined lengths to thereby form a plurality of steel plates;

bending said steel plates to form a longitudinally extending base, opposed sidewalls angularly disposed relative to said base at respective angles greater than 90°, and a top wall constituted by inwardly directed extensions of said sidewalls which terminate in spaced apart longitudinally extending edges;

arranging said bent steel plates in series in a longitudinal direction so that the rear longitudinal end of one steel plate is in abutment with the front longitudinal end of the next steel plate;

tack welding at least a part of said abutting ends of said bent steel plates to form an elongated tack-welded plate;

positioning a plurality of outer rollers having at least one horizontal lower roll, two side rolls and one horizontal upper roll, said rolls being positioned externally of said elongated tack-welded plate and in contact respectively with said base, said sidewalls and said top wall;

effecting relative longitudinal movement between said elongated tack-welded plate and said outer rollers to thereby bend said sidewalls normal to said base and to press said longitudinally extending edges of said top wall into substantially abutting relationship and thereby form an elongated abutment extending longitudinally along said elongated tack-welded plate;

welding said elongated abutment continuously such that the welding proceeds continuously along said elongated tack-welded plate from one tack-welded steel plate to the next successive tack-welded steel plate; and cutting said elongated tack-welded steel pipe at said tack-welded parts thereof to thereby provide a plurality of predetermined lengths of rectangular or square steel pipes.

2. A process as defined in claim 1, wherein said predetermined lengths of rectangular or square steel pipes are passed through a strain removal zone to remove strain from said pipes are are thereafter passed through a weld inspection zone for the inspection of said weld of said elongated abutment.

3. A process as defined in claim 1, wherein there are a plurality of said outer rollers spaced apart from one another longitudinally of said elongated tack-welded plate.

4. A process as defined in claim 1, wherein said steel plates are passed through said processing steps supported on rollers.

5. A process as defined in claim 1, wherein said tack welding is effected by tack-welding means reciprocated along the path of longitudinal movement of said bent steel plates.

6. A process as defined in claim 1, wherein said tack welding is applied at the longitudinal ends of the extensions constituting the top walls of said bent steel plates.

* * * * *